US006321555B1

(12) United States Patent
Buratti et al.

(10) Patent No.: US 6,321,555 B1
(45) Date of Patent: Nov. 27, 2001

(54) DEFROSTING DEVICE, IN PARTICULAR FOR REFRIGERATION SYSTEMS

(75) Inventors: Maurizio Buratti, Lonate Pozzolo; Antonio Fiorentini, Milan, both of (IT)

(73) Assignee: I.R.C.A. S.p.A Industria Resistenze, San Vendemiano (IT)

( * ) Notice: Subject to any disclaimer, the term of this patent is extended or adjusted under 35 U.S.C. 154(b) by 0 days.

(21) Appl. No.: 09/623,499

(22) PCT Filed: Feb. 25, 1999

(86) PCT No.: PCT/EP99/01227

§ 371 Date: Sep. 19, 2000

§ 102(e) Date: Sep. 19, 2000

(87) PCT Pub. No.: WO99/47870

PCT Pub. Date: Sep. 23, 1999

(51) Int. Cl.[7] ..... F25D 21/00

(52) U.S. Cl. ..... 62/272; 62/276; 62/275; 62/151

(58) Field of Search ..... 62/275, 272, 276, 62/151

(56) References Cited

U.S. PATENT DOCUMENTS

| | | | | |
|---|---|---|---|---|
| 3,822,560 | * | 7/1974 | Hansen et al. | 62/140 |
| 3,946,286 | * | 3/1976 | Kinnunen et al. | 317/124 |
| 4,246,489 | | 1/1981 | Yoshida et al. . | |
| 4,782,331 | | 11/1988 | Martens . | |
| 4,860,551 | | 8/1989 | Query . | |
| 4,995,244 | * | 2/1991 | Steers et al. | 62/155 |
| 6,213,405 | * | 4/2001 | Spiegel | 237/2 |

FOREIGN PATENT DOCUMENTS

| | | |
|---|---|---|
| 24 56 060 | 11/1974 | (DE) . |
| 2 212 913 | 2/1989 | (GB) . |

* cited by examiner

*Primary Examiner*—William Doerrler
*Assistant Examiner*—Mark S. Shulman
(74) *Attorney, Agent, or Firm*—Hoffman, Wasson & Gitler PC

(57) ABSTRACT

A device for defrosting the finned cooling assembly of a refrigeration system having an ellipsoid transparent polymer material housing a light source. The light source is positioned substantially in correspondence with one of the focal points of the ellipsoid. A sensor for the light beam radiated by the light source and reflected by an inner surface of the ellipsoid recognize variations in the luminous intensity of the beam caused by the formation of frost along the path of the light beam. A plurality of finned cooling assemblies are activated by the signal emitted by the sensor.

6 Claims, 2 Drawing Sheets

DEFROSTING DEVICE, IN PARTICULAR FOR REFRIGERATION SYSTEMS

This invention relates to a defrosting device, in particular for refrigeration systems.

In refrigeration units, the finned assembly is defrosted by the use of heating elements in contact with the assembly itself. Said heating elements are in the form of electrical resistance elements, which are powered at predetermined time intervals for a constant period. If excessive heating occurs, a safety thermostat ensures that the items contained in the refrigeration unit remain preserved, by deactivating the heating elements.

This known defrosting system has the drawback of non-optimum defrosting of the finned because the powering of the heating elements is not correlated with the effective presence of frost. This can result in:

activation of the heating elements even if frost is not present on the finned assembly, with consequent energy consumption and increase in the temperature of the environment, resulting in damage to the food, inefficient heat transfer by the refrigeration assembly due to the presence of frost because of delay in operation of the heating elements.

This drawback is eliminated according to the invention by a device for defrosting the finned cooling assembly of a refrigeration system as described in claim 1.

Figure 1:
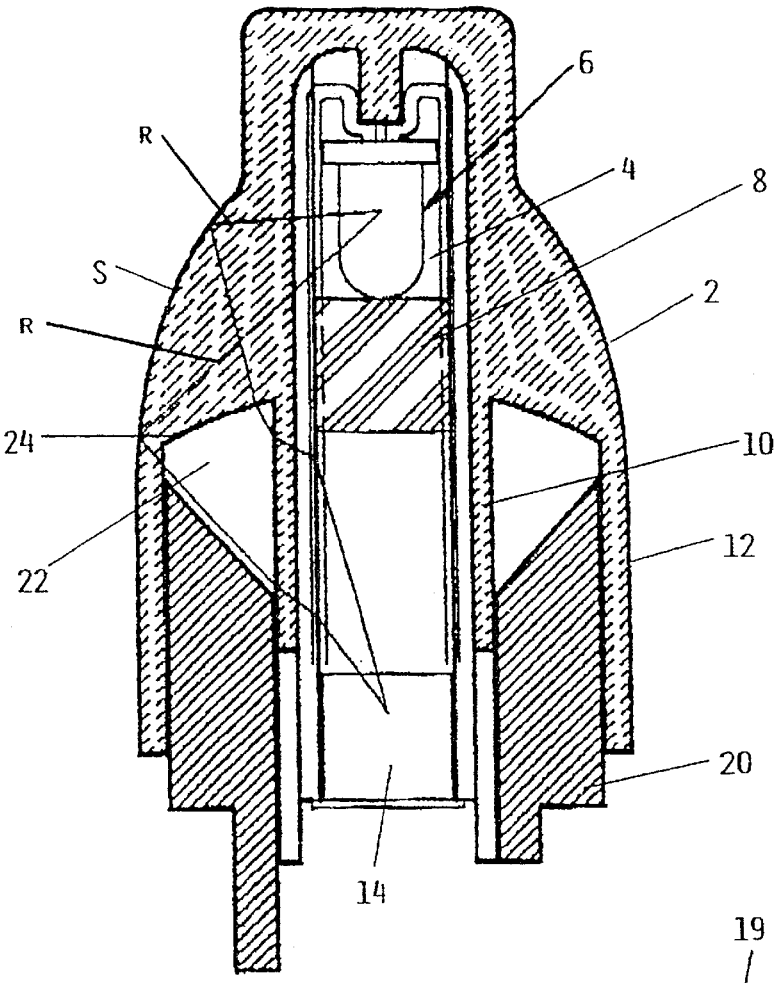
Figure 2:
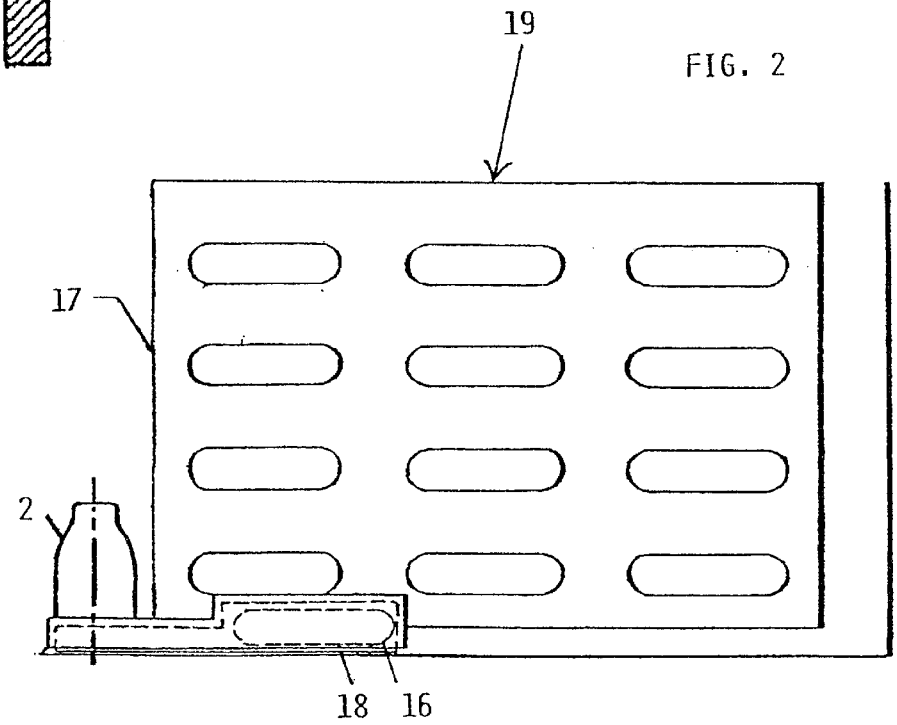
Figure 3:
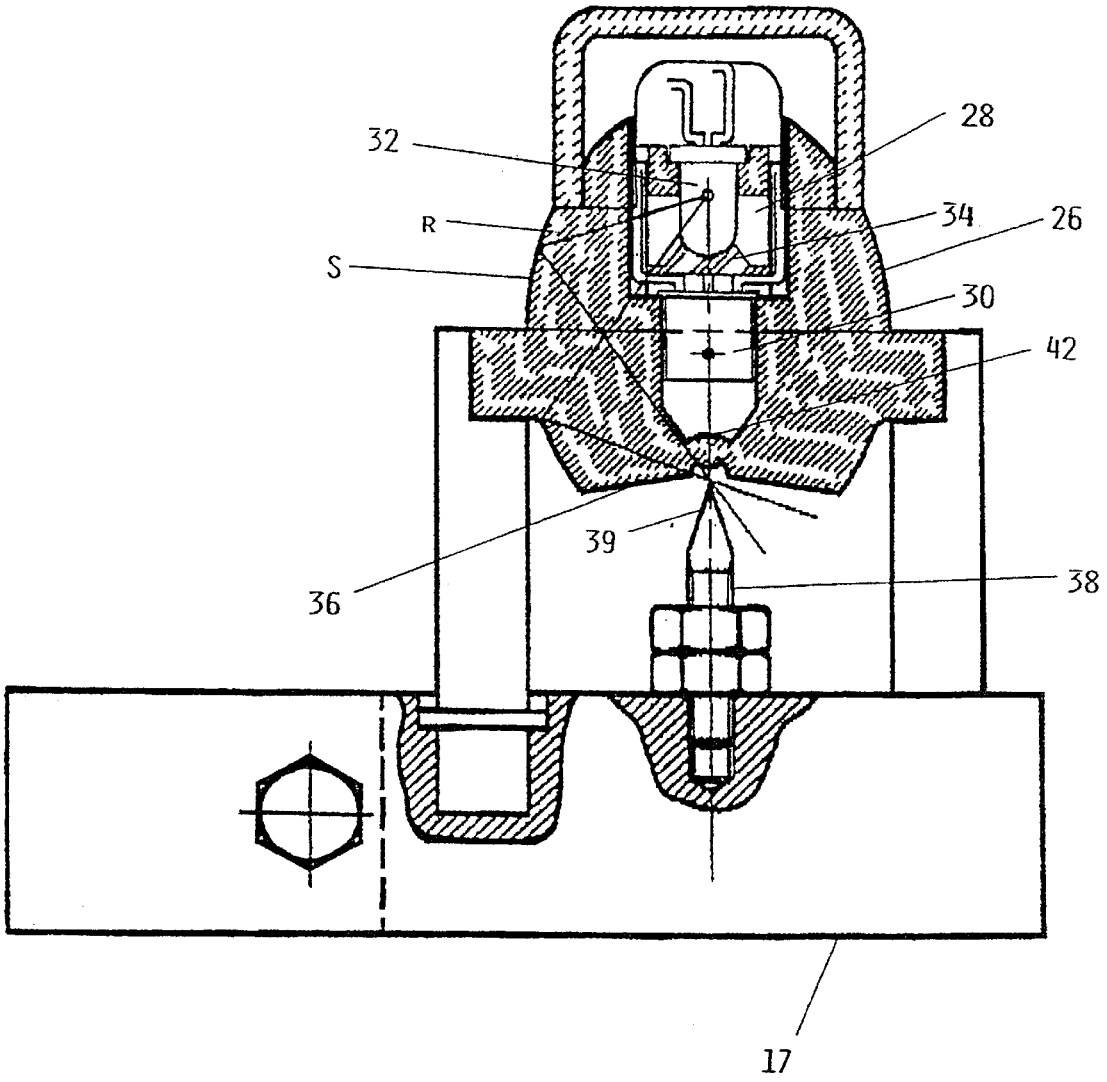

A preferred embodiment of the present invention and one modification thereof are described in detail hereinafter by way of non-limiting example with reference to the accompanying drawings, in which:

FIG. 1 is a schematic view of a first embodiment of the device of the invention, FIG. 2 shows it mounted on the finned assembly, and FIG. 3 shows a modification thereof.

As can be seen from the figures the device of the invention consists of an ellipsoid portion 2, of eccentricity between 0.4 and 0.75, constructed of transparent polymer (for example polypentenes, PMMA, water-saturated transparent polyamides, etc.) having a refractive index to air of about 1.49.

Within the ellipsoid 2 there is provided a seat 4 housing a light emitting diode 6 (preferably a 940 nm IRED) positioned preferably in proximity to a focal point of the ellipsoid. The diode seat 4 is closed by a plug 8 of black plastic. Said ellipsoid portion is prolonged in the form of two concentric tubes 10, 12, in one of which, namely in the inner tube 10, there is housed a photodetector 14 connected to a control unit for an electrical resistance element 16 mounted on a bracket 18 facing the finned assembly 17 of the refrigeration unit 19.

In particular, said photodetector is positioned substantially in correspondence with the other focal point of the ellipsoid.

In the annular compartment bounded by the two tubes 10, 12 there is housed a copper tube 20 having that end surface facing the ellipsoid substantially inclined to the tube axis so as to define with the ellipsoid an annular aperture 22 having two walls formed by portions of the tubes 10, 12, one wall formed by the copper tube 20, and one wall 24 formed by the body of the ellipsoid itself.

That end of the copper tube external to the ellipsoid is rigid with the bracket 18, so as to achieve good thermal contact.

The device of the invention operates in the following manner: when frost is absent, because of the geometrical characteristics of the ellipsoid the light rays leaving the diode 6 strike a region of the ellipsoid surface 5 with an angle of incidence (>43°) which is greater than the limiting angle corresponding to the refractive index of the ellipsoid to air. Consequently the rays r are not refracted, but instead are reflected within the ellipsoid itself, to then emerge therefrom through the annular band 24 which lies substantially perpendicular to the rays. The light rays then interfere with the inner annular portion of the tube 10, to undergo double refraction and be conveyed onto the photodetector 12, which consequently receives all the light rays emitted by the diode onto the surface S.

In this configuration, in which the intensity of the radiation received by the photodetector is a maximum, the resistance element 16 is not powered.

At that moment in which, during the operation of the refrigeration unit, frost microcrystals form on the outer surface of the ellipsoid, the refractive index of the ellipsoid to said microcystals covering it varies by virtue of the presence of these covering microcystals. As this refractive index decreases, with consequent increase in the limiting angle corresponding to the new refractive index, the rays radiated by the diode and which strike this region are no longer reflected, but instead are refracted with consequent isotropic light diffusion to the outside.

This situation consequently results in a decrease in the luminous intensity of the rays sensed by the photodetector. Moreover the presence of frost on the annular surface 24 causes a maked defocusing of the beam, contributing to accelerating the extinguishing of the light beam received by the photodetector. Consequently the photodetector feeds a different signal to the control unit, which compares it with the basic signal previously received when all the rays struck the photodetector, the control unit causing the resistance element 16 to operate when the ratio of the attenuated signal to the basic signal reaches the order of 50%.

The activation of the resistance element 16 results both in the defrosting of the finned assembly 17 and, by virtue of the heat conducted through the bracket 18 and the annular tube 10, the defrosting of the outer surface of the ellipsoid body, which consequently returns to its initial state in which the photodetector 12 receives virtually all the rays transmitted by the diode. The control unit consequently receives a signal substantially similar to the basic signal, to consequently deactivate the resistance element.

In the embodiment shown in FIG. 3, the device of the invention consists substantially of a truncated portion of ellipsoid 26, also of transparent polymer material but with its outer surface 5 metalized. Along the major axis of the portion there is provided a seat 28 housing a photodetector 30, and a light source 32 in the form of an LED positioned substantially in correspondence with the focal point of the ellipsoid.

A black mask 34 is interposed between the light source 32 and the photodetector 30 so that the rays emitted by this source cannot directly strike the photodetector.

External to the ellipsoid, in correspondence with its substantially circular surface 36, there is provided a metal needle 38 with its burnished mirror-like tip positioned to correspond with the position which would have corresponded with the other focal point of the ellipsoid if this had not been truncated. The other end of the needle is in thermal contact with the finned assembly 17.

The circular surface 38 and the end surface of the seat 28 are curved and shaped to form a micro-lens 42.

This embodiment of the device of the invention operates in the following manner:

under normal conditions the light rays r radiated by the LED 30 are reflected by the metallized surface of the ellipsoid and fed to the tip of the needle. When in this configuration the photodetector receives no radiation and consequently feeds no signal to the control unit for activating the resistance element. In the same manner the burnished tip 39 generates to radiation towards the photodetector, even if it interferes with the beam. At that moment in which, as result of the operation of the refrigeration machine, a layer of frost forms on the finned assembly, the thermal connection between the metal needle 38 and the finned assembly 17 creates the same frost conditions on the tip 39 as on the finned assembly. The increase in the frost thickness on the needle causes its frost crystals to interfere with the light bean radiated by the LED and reflected by the surface S of the ellipsoid, with the formation of an isotropic light source with conjugate image by the LED primary source, which via the micro-lens 42 is fed to the photodetector 30, which feeds a signal to the control unit causing it to activate the resistance element in order to defrost the finned assembly 17.

In this case the defrosting of the finned assembly also causes defrosting of the needle tip. The result is the restoration of normal conditions with no radiation received by the photodetector, which feeds a signal to the control unit to deactivate the resistance element.

From the aforegoing it is apparent that the device presents numerous advantages, and in particular:

it provides rapid and effective defrosting of the finned assembly as the resistance element operates only if frost is present, energy costs are reduced as it operates only when frost is present, accurate control is obtained on the basis of the thickness of the frost present on the distributor.

What is claimed is:

1. A device for defrosting the finned cooling assembly (17) of a refrigeration system, characterised by comprising:

an ellipsoid (2,26) of transparent polymer material housing a light source (6,32) positioned substantially in correspondences with one of the focal points, and a sensor (12,30) for the light beam radiated by said source and reflected by the inner surface of the ellipsoid, a plurality of heating and defrosting elements (18) for the finned cooling assembly (17), which are activated by a signal emitted by the sensor (12,30) when this senses a variation in the luminous intensity of the beam, said variation in luminous intensity of the beam being caused by the formation of frost along the path of the light beam.

2. A device as claimed in claim 1, characterised in that said ellipsoid (2) has a refractive index to air and an eccentricity such that if frost is absent the rays emitted by the light source (6) are reflected directly onto the photodetector (12), whereas if frost is present said rays are refracted so that the photodetector senses a variation in luminous intensity.

3. A device as claimed in claim 2, characterised in that said ellipsoid has a refractive index of 1.49 and an eccentricity of between 0.4 and 0.75.

4. A device as claimed in claim 2, characterised in that said ellipsoid is provided with a conducting tube (20) thermally connected to the heating elements (18), so that activation of said elements (18) also causes the frost on the ellipsoid surface to melt.

5. A device as claimed in claim 1, characterised in that said ellipsoid (2) has a metallized outer surface and comprises, in correspondence with the other focal point, a black body which following the formation of frost interferes with the rays radiated by light source, to feed them to the photodetector via an optical system (42).

6. A device as claimed in claim 5, characterised in that said black body consists of a needle with its tip positioned in correspondence with the focal point and with its other end in contact with the finned assembly.

* * * * *